United States Patent [19]

Linder et al.

[11] Patent Number: 5,020,728

[45] Date of Patent: Jun. 4, 1991

[54] FUEL INJECTION NOZZLE FOR INTERNAL COMBUSTION ENGINES

[75] Inventors: Ernst Linder, Mühlacker; Helmut Rembold, Stuttgart, both of Fed. Rep. of Germany

[73] Assignee: Robert Bosch GmbH, Stuttgart, Fed. Rep. of Germany

[21] Appl. No.: 449,968

[22] PCT Filed: Mar. 22, 1988

[86] PCT No.: PCT/DE88/00176

§ 371 Date: Dec. 11, 1989

§ 102(e) Date: Dec. 11, 1989

[87] PCT Pub. No.: WO88/09869

PCT Pub. Date: Dec. 15, 1988

[30] Foreign Application Priority Data

Jun. 11, 1987 [DE] Fed. Rep. of Germany ..... 3719459

[51] Int. Cl.[5] ..... F02M 61/00

[52] U.S. Cl. ..... 239/533.12; 239/533.3; 239/453; 239/456

[58] Field of Search ..... 239/533.2, 533.3, 533.4, 239/533.5, 533.6, 533.7, 533.8–533.12, 453, 456, 459, 541, 584

[56] References Cited

U.S. PATENT DOCUMENTS

| | | | |
|---|---|---|---|
| 2,063,709 | 12/1936 | Taylor . | |
| 2,820,673 | 1/1958 | Zubaty . | |
| 4,082,224 | 4/1978 | Mangus | 239/533.12 |
| 4,197,997 | 4/1980 | Wu et al. | 239/533.12 |
| 4,394,972 | 7/1983 | Potter | 239/533.12 |
| 4,817,873 | 4/1989 | McKay | 239/533.12 |
| 4,958,771 | 9/1990 | Klomp | 239/453 |

FOREIGN PATENT DOCUMENTS

| | | | |
|---|---|---|---|
| 3737896 | 5/1989 | Fed. Rep. of Germany | 239/533.9 |
| 684482 | 11/1928 | France . | |

*Primary Examiner*—Andres Kashnikow
*Assistant Examiner*—Christopher G. Trainor
*Attorney, Agent, or Firm*—Michael J. Striker

[57] ABSTRACT

Fuel injection nozzle for internal combustion engines, in which a pre-injection is effected with directed fuel sprays and then a main injection is effected with an additional fuel umbrella spray. The individual phases are to run in exact timed sequence and the main injection is to be separated from the pre-injection by way of a pressure step. For this purpose, a valve sleeve (34) is placed on a valve needle (18) which opens in the flow direction of the fuel and is provided with a closing head (20), the valve sleeve (34) being pressed, according to the invention, by an additional spring (50) against the closing head (20) with which it controls an annular valve gap for the umbrella spray. The valve sleeve (34) is also provided with lateral spray openings (62) through which the directed sprays exit during the pre-stroke in which the valve sleeve (34) moves with the valve needle (18) under the influence of the additional spring (50). After the pre-stroke, the valve sleeve (34) is prevented from further movement, so that the additional spring (50) is neutralized and the valve gap is opened for the umbrella spray.

8 Claims, 2 Drawing Sheets

FUEL INJECTION NOZZLE FOR INTERNAL COMBUSTION ENGINES

BACKGROUND OF THE INVENTION

The present invention relates to a fuel injection nozzle, especially for internal combustion engines.

A known fuel injection nozzle comprises a nozzle body and a valve needle having a closing head which is displaceably supported in a nozzle body and pressed opposite the fuel flow by a closing spring toward a first stop, which is fixed with respect to the housing. This valve needle is acted on in the opposite direction by fuel in the flow direction. The fuel injection nozzle also comprises a valve sleeve which is displaceably supported in the nozzle body upstream of the closing head of the valve needle and, together with the valve needle, defines a pressure space which is filled with fuel, and is provided in the area of this pressure space with lateral spray openings for directed fuel sprays and controls a valve gap for central fuel umbrella sprays with its front edge and a conical valve seat face at the closing head of the valve needle. The fuel injection nozzle also comprises a spring element for pressing the valve sleeve against the closing head of the valve needle into its closing position and also a second stop, which is fixed with respect to the housing, at which the valve sleeve, which first moves along the valve needle during the opening stroke, comes to rest after a pre-stroke which controls the lateral spray openings, so that the closing head is lifted from the valve sleeve and opens the valve gap for the central umbrella sprays of the fuel.

In a known injection nozzle of this type (DE-A1-32 13 751, FIG. 1) the first stop, which is fixed with respect to the housing and serves to support the valve needle in the closed position, is formed by an annular shoulder which is arranged upstream of the closing spring in the nozzle holder, the valve needle being supported at the annular shoulder via the valve sleeve and an additional tubular intermediate piece enclosing the valve needle. In this injection nozzle the closing spring simultaneously forms the spring element for pressing the valve sleeve against the closed head of the valve needle in its closing position. This construction has the disadvantage that the relatively thin-walled valve sleeve is subjected to a high impact stress due to the action of the strong closing spring when the valve needle impacts on the first stop, which is fixed with respect to the housing, and that, immediately after the valve needle lifts from this stop, the valve sleeve is only influenced by the pressures exerted by the fuel on both sides of the end faces of the valve sleeve. Accordingly, an unstable operating behavior results in which an exact timed sequence of the opening of the spray openings for the directed fuel sprays and of the valve gap for the fuel umbrella spray is not ensured. The same disadvantage is associated with another known structure (DE-A1-32 13 751, FIG. 5) in which the valve needle contacts a valve seat with its closed head in the closed position, the valve seat being fixed with respect to the housing; but again, and moreover also in the closing position of the valve needle, the valve sleeve is acted upon only by the fuel pressure, so that a defined opening sequence is not ensured.

SUMMARY OF THE INVENTION

It is an object of the present invention to provide an improved fuel injection nozzle for an internal combustion engine which is characterized by a more stable operating behavior with a more well defined opening sequence.

It is also an object of the present invention to provide an improved fuel injection nozzle of the above-described kind in which the valve sleeve is subjected to reduced impact stresses on closing so that an exacted timed sequence of opening of the spray openings for the directed fuel sprays and the fuel gap is ensured.

These objects and others which will be made more apparent hereinafter are attained in a fuel injection nozzle in which the first stop, which is fixed relative to the housing and serves to support the valve needle in the closed position, is formed in a manner known per se by a valve seat at the nozzle body. This valve seat defines a second valve gap together with the closing head of the valve needle. This second valve gap is subsequent to the spray openings of the valve sleeve and the central valve gap formed between the latter and the closing head. An additional spring element is provided for pressing the valve sleeve against the closing head, which is supported upstream at a shoulder, which is fixed with respect to the housing and encloses the valve needle, and acts continuously on the valve sleeve.

In contrast, the arrangement, according to the invention, with the characterizing features of the main claim has the advantage that during the pre-stroke the valve sleeve moves instantaneously guided positively by the additional spring element of the valve needle until at the stop, so that the predetermined time sequence for controlling the spray openings for the directed fuel sprays and the central valve gap for the fuel umbrella spray is accurately maintained. Moreover, after the support of the valve sleeve at the second stop which is fixed with respect to the housing, the influence of the force of the additional spring element on the valve needle, which force acts against the closing spring, ceases so that the fuel pressure must first increase by a predetermined step before the central valve gap opens and the fuel umbrella spray exits, so that a good atomizing of the fuel is also ensured in the main injection.

Advantageous developments of the arrangement according to the main claim are made possible by means of the steps indicated in the subclaims.

A structure which is simple to assemble results when the shoulder which is fixed with respect to the housing and serves to support the additional spring element, which is preferably constructed as a helical compression spring, is formed at the downstream front side of a bushing which is screwed into the nozzle body, the upstream end portion of the bushing guides the valve needle and is provided with an axial shoulder for supporting the closing spring.

A secure sealing of the valve gap for the fuel umbrella spray in the closed position of the valve needle results when the front side of the valve sleeve facing the closing head of the valve needle is constructed so as to be inwardly conical and its cone angle is selected so as to be smaller than the cone angle of the valve seat face of the closing head. An edge-like contact accordingly results between the two parts defining the valve gap, in which a high surface pressure can be achieved which is a contributory determinant for the tightness.

For the same purpose, it is suggested that the valve seat at the nozzle body, which valve seat cooperates with the closing body of the valve needle, is constructed as a sealing edge whose diameter preferably corresponds approximately to the guide diameter of the valve sleeve in the nozzle body.

Claims 5 to 10 contain advantageous steps for designing the course of injection and for the spatial separation of the pre-injection and main injection which reduces the tendency of the injection nozzle to form rust.

BRIEF DESCRIPTION OF THE DRAWINGS

The objects, features and advantages of the present invention will now be made more apparent by the following detailed description, reference being made to the drawing in which.

DETAILED DESCRIPTION OF THE DRAWING

Figure 1:
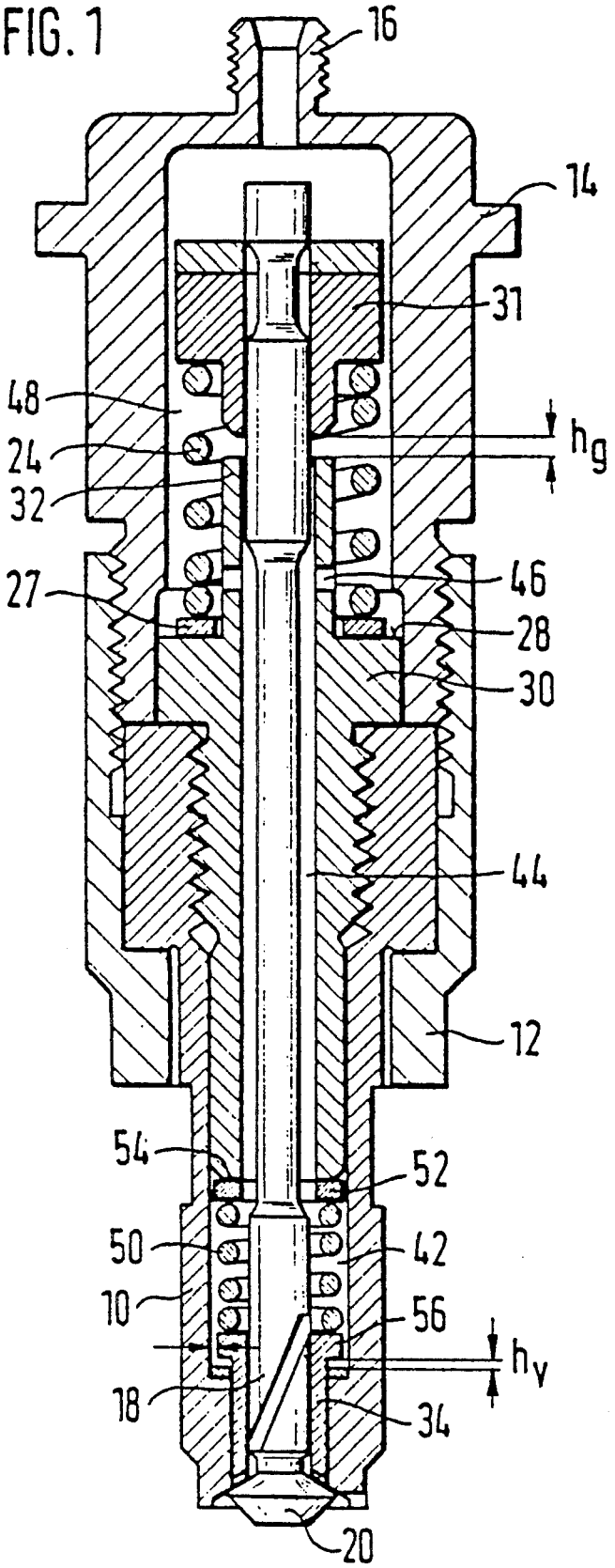
FIG. 1 is a longitudinal cross sectional view through one embodiment of a fuel injection nozzle.

The injection nozzle comprises a nozzle body 10 which is tightened by means of a union nut 12 at a nozzle holder 14 which comprises a connection fitting 16 for a fuel supply line. A valve needle 18, which is provided with a closing head 20 at the end on the side of the combustion chamber, is supported in the nozzle body 10 using means which are described in more detail in the following. This closing head 20 comprises a conical valve seat face 22 (FIG. 2) which is pressed by a closing spring 24 against a valve seat 26 at the nozzle body 10, which valve seat 26 is constructed as a sealing edge. The closing spring 24 is supported via an annular disk 27 at an annular shoulder 28 of a bushing 30, which is screwed into the nozzle body 10, and acts at the upper end of the valve needle 18 in a conventional manner via a support body 31, the valve needle 18 being guided in a collar-shaped projection 32 of the bushing 30. In the shown closed position of the valve needle 18, the support body 31 sits at an axial distance $h_g$ relative to the upper end face of the bushing 30, 32 corresponding to the total lift of the valve needle 18.

The valve needle 18 is supported upstream of the closing head 20 in a valve sleeve 34 which is guided in turn so as to be displaceable, but non-rotatable, in the nozzle body 10 using means which are not shown. The guide diameter corresponds to the diameter of the valve seat 26 at the nozzle body 10. A pressure space 38 which is filled with fuel is formed between the valve sleeve 34 and a portion 36 of the valve needle 18 which is reduced in diameter, the pressure space 38 being connected with a chamber 42 in the nozzle body 10 via a diagonally extending longitudinal groove 40 in the guided portion of the valve needle 18. This chamber 42 communicates, via an annular space 44 and transverse bore holes 46 in the bushing 30, with a chamber 48 in the nozzle holder 14 in which the closing spring 24 is arranged, the connection fitting 16 opening into this chamber 48.

A pressure spring 50, which is supported at the lower front side 54 of the bushing 30 via an annular disk 52 and acts at an annular collar 56 of the valve sleeve 34, is arranged in the chamber 42. The lower front side of the valve sleeve 34 is constructed so as to be conical on the inside and its cone angle is selected so as to be smaller than the cone angle of the valve seat face 22 at the closing head 20. Accordingly, a sealing edge 58 which, together with the closing head 20, forms and controls a valve gap for central fuel umbrella sprays results at the outer circumference of the valve sleeve 34. In the shown closed position of the valve needle 18, the sealing edge 58 of the valve sleeve 34 contacts the closing head 20 so as to seal under the influence of the pressure spring 50, wherein the annular collar 56 of the valve sleeve 34 is at a distance $h_v$ axially relative to the annular disk 59 which is supported on an annular shoulder 60 of the nozzle body 10.

The valve sleeve 34 is provided with a plurality of radial slots 62 at the circumference of the outer surface area, which radial slots 62 lead out of the pressure space 38 and form spray openings for directed fuel sprays, so-called string sprays. In the closed position of the valve needle 18 shown in FIG. 2, the slots 62 are closed tightly toward the combustion chamber by means of the bore hole wall of the nozzle body 10 and, additionally, by means of the closing head 20 contacting the valve seat 26. A spherically curved guiding wall 64 for the fuel umbrella spray adjoins the valve seat 26 and extends until the front wall 66 of the nozzle body 10 on the combustion chamber side, where it opens out at a cone angle which is smaller than the cone angle of the valve seat face 22 at the closing head 20. The annular rim area of the nozzle body 10 enclosing the guiding wall 64 is likewise provided with radial slots 68 in the radial planes of the slots 62, the directed fuel string sprays reaching the combustion chamber in an unimpeded manner through these radial slots 68.

The described injection nozzle works as follows: when the increasing fuel pressure has reached the differential force of the two springs 24 and 50 at the beginning of an injection process, the valve needle 18 and the valve sleeve 34 are jointly displaced in a downward direction, wherein the slots 62 in the valve sleeve 34 are released and directed fuel sprays are injected into the combustion chamber in the desired direction. When the parts have traveled the pre-stroke $h_v$, the valve sleeve 34 comes to rest at the annular disk 59 or annular shoulder 60 of the nozzle body 10, respectively. The pressure spring 50 then no longer acts in the opening direction on the valve sleeve 34 and the valve needle 18, so that the fuel pressure must first increase by a certain step before it is capable by itself of displacing the valve needle 18 into the end position in which the support body 31 impacts at the bushing 30. During this residual stroke of the valve needle 18, the closing head 20 rises from the valve sleeve 34 so that the annular valve gap between these parts is opened and the fuel, which is sprayed out under high pressure, reaches the combustion chamber additionally in the form of an umbrella spray. The movements of the parts proceed in the opposite sequence at the end of the injection process.

Figure 2:
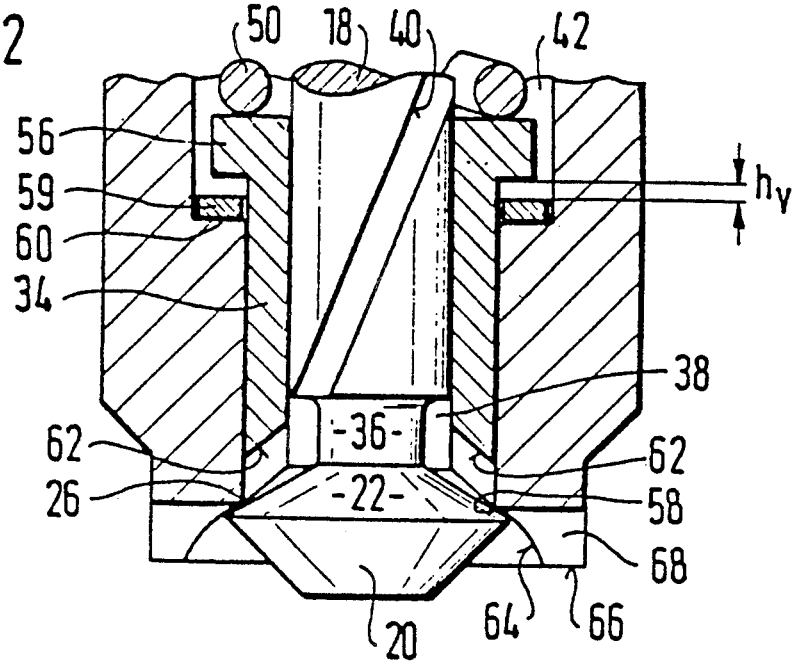
FIG. 2 is a detailed cutaway cross sectional view of the injection nozzle shown in FIG. 1.

In the construction according to FIG. 2, the injection openings for the directed fuel sprays are formed by means of radial slots 62 which are open on the front and are therefore simultaneously released immediately at the beginning of the valve needle opening movement. In many cases, however, it may be advisable to release the spray openings for the directed fuel sprays at different times by means of axial displacement. In other cases it can be advantageous that the directed fuel sprays are not sprayed out radially or that the spraying direction changes along the stroke of the valve sleeve 34, respectively.

Figure 3:
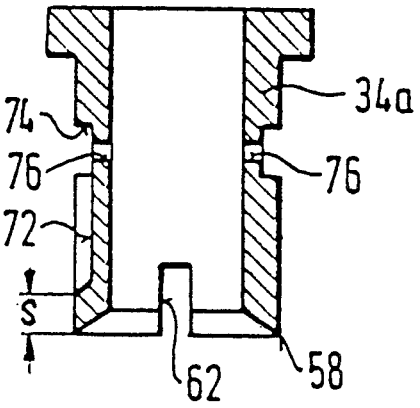
FIG. 3 is a cross sectional view of another embodiment of a valve sleeve according to our invention.

FIG. 3 shows a variant 34*a* of the valve sleeve which comprises two diametrically opposite slots 62 for fuel spraying out immediately at the beginning of the opening and a longitudinal slot 72 for fuel spraying out with a slight delay, which longitudinal slot 72 is offset by 90° relative to the slots 62. This longitudinal slot 72 proceeds from an annular groove 74, which is connected with the pressure space 38 via transverse bore holes 76, and ends at an axial distance s before the sealing edge 58 of the valve sleeve 34*a*, which corresponds to the desired delay.

Figure 4:
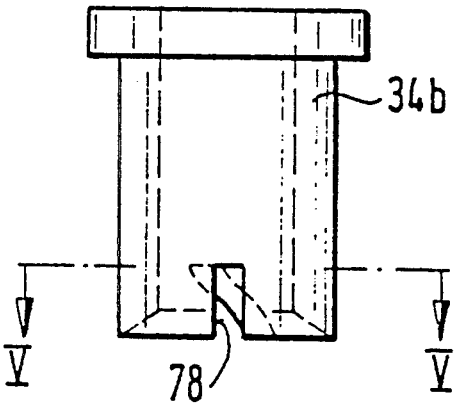
FIG. 4 is a side view of an additional embodiment of a valve sleeve according to our invention.
Figure 5:
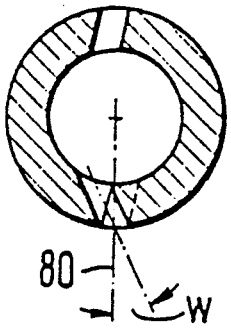
FIG. 5 is a transverse cross sectional view of the valve sleeve of FIG. 4 taken along the section line V—V in FIG. 4.

In the variant according to FIG. 4, the valve sleeve 34*b* is provided with slots 78 which, like the slots 62, penetrate the entire wall of the valve sleeve and also open out at its front side. The peculiarity of the slot 78 is that it has a different outlet angle w relative to the radial plane 80 along its entire axial length. These slots 78 can be produced e.g. by means of a laser beam in rotating and displacing valve sleeves 34*b*.

A similar effect can be achieved if, instead of a helical slot 78, a simple bore hole or a straight longitudinal slot is provided and the valve sleeve 34*b* is forced to rotate during its longitudinal displacement. For example, this can be effected by means of a pin which is fixed with respect to the housing and which engages in a correspondingly shaped cam-like groove in the collar of the valve sleeve 34*b*.

The "first stop" referred to in the following claims and in the summary above corresponds to the sealing edge 58 on which the closing head 20 comes to rest when the valve needle is in the closed position in the above embodiments.

The "second stop" referred to in the following claims and in the summary above corresponds to the annular disk 59 on which the valve sleeve 34 comes to rest.

It will be understood that each of the elements described above, or two or more together, may also find a useful application in other types of structures differing from the types described above.

While the invention has been illustrated and embodied in a fuel injection nozzle for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. A fuel injection nozzle for internal combustion engines comprising a nozzle body having a valve seat; a valve needle displaceable in said nozzle body and having a closing head for engaging said valve seat; a first spring for biasing said closing head of said valve needle into engagement with said valve seat, said valve seat defining a first stop for said valve needle, and said first spring biasing said closing head in a direction opposite to a direction in which axial forces resulting from flow of fuel in said nozzle body, act on said valve needle, said valve seat and said closing head of said valve needle defining an outer valve annular gap upon disengagement of said closing head from said valve seat; a valve sleeve displaceably supported in said nozzle body upstream of said closing head and connected with said valve needle for joint axial displacement and relative thereto, said valve sleeve and said valve needle defining a fuel filled pressure space, and said valve sleeve having, in a vicinity of said pressure space, a plurality of lateral spray openings for directing clustered fuel sprays, said closing head having a conical seat surface for engaging said valve seat and said valve sleeve having a downstream end edge for defining with said conical seat surface an inner valve annular gap for directing a central fuel umbrella spray; a second stop fixedly connected with said nozzle body and engageable by said valve sleeve during an opening stroke and after said valve sleeve and said valve needle joint axial displacement, said joint axial displacement controlling fuel flow through said lateral spray openings wherein upon engagement of said valve sleeve with said second stop said closing head is lifted off said valve sleeve and said inner valve annular gap is formed; a second spring for biasing said valve sleeve into engagement with said closing head and acting constantly in a direction of opening movement of said valve needle; and stop means surrounding said valve needle and secured in said nozzle body for at least partially supporting said second spring; said valve seat defining a sealing edge having a diameter substantially corresponding to a guide diameter of said valve sleeve in said nozzle body, said nozzle body further having a spherically curved guiding wall located adjacent said valve seat for directing the fuel umbrella spray said guiding wall having a front end surface, said guiding wall having a cone angle at said front end surface smaller than a cone angle of said conical seat surface of said closing head; said nozzle body having an annular rim area enclosing said guiding wall and a plurality of slots provided in said rim area and coinciding with said plurality of lateral spray openings in said valve sleeve upon a respective downward movement of said valve sleeve, for guiding fuel sprays emitted from said plurality of lateral spray openings.

2. A fuel injection nozzle for internal combustion engines, comprising a nozzle body have a valve seat; a valve needle displaceable in said nozzle body and having a closing head for engaging said valve seat; a first spring for biasing said closing head of said valve needle into engagement with said valve seat, said valve seat defining a first stop for said valve needle, and said first spring biasing said closing head in a direction opposite to a direction in which axial forces resulting from flow of fuel in said nozzle body, act on said valve needle, said valve seat and said closing head of said valve needle defining an outer valve annular gap upon disengagement of said closing head from said valve seat; a valve sleeve displaceably supported in said nozzle body upstream of said closing head and connected with said valve needle for joint axial displacement and relative thereto, said valve sleeve and said valve needle defining a fuel filled pressure space, and said valve sleeve having, in a vicinity of said pressure space, a plurality of lateral spray openings for directing clustered fuel sprays, said closing head having a conical seat surface for engaging said valve seat and said valve sleeve having a downstream end edge for defining with said conical seat surface an inner valve annular gap for directing a central fuel umbrella spray; a second stop fixedly connected with said nozzle body and engageable by said valve sleeve during an opening stroke and after said valve sleeve and said valve needle joint axial displacement, said joint axial displacement controlling fuel flow through said lateral spray openings wherein upon engagement of said valve sleeve with said second stop said closing head is lifted off said valve sleeve and said inner valve annular gap is formed; a second spring for biasing said valve sleeve into engagement with said closing head and acting constantly in a direction of opening movement of said valve needle; and stop means surrounding said valve needle and secured in said nozzle body for at least partially supporting said second spring, said valve sleeve having at least one of said plurality of lateral spray openings such that a direction of a said clustered fuel spray emitted therefrom changes during axial displacement of said valve sleeve.

3. A fuel injection nozzle according to claim 2, wherein said at least one of said lateral spray openings has a longitudinal extension and an outlet spray angle that changes relative to a radial plane along a portion of the axial longitudinal extension of said at least one of said lateral spray openings.

4. A fuel injection nozzle for internal combustion engines, comprising a nozzle body having a valve seat; a valve needle displaceable in said nozzle body and having a closing head for engaging said valve seat; a first spring for biasing said closing head of said valve needle into engagement with said valve seat, said valve seat defining a first stop for said valve needle, and said first spring biasing said closing head in a direction opposite to a direction in which axial forces resulting from flow of fuel in said nozzle body, act on said valve needle, said valve seat and said closing head of said valve needle defining an outer valve annular gap upon disengagement of said closing head from said valve seat; a valve sleeve displaceably supported in said nozzle body upstream of said closing head and connected with said valve needle for joint axial displacement and relative thereto, said valve sleeve and said valve needle defining a fuel filled pressure space, and said valve sleeve having, in a vicinity of said pressure space, a plurality of lateral spray openings for directing clustered fuel sprays, said closing head having a conical seat surface for engaging said valve seat and said valve sleeve having a downstream end edge for defining with said conical seat surface an inner valve annular gap for directing a central fuel umbrella spray; a second stop fixedly connected with said nozzle body and engageable by said valve sleeve during an opening stroke and after said valve sleeve and said valve needle joint axial displacement, said joint axial displacement controlling fuel flow through said lateral spray openings wherein upon engagement of said valve sleeve with said second stop said closing head is lifted off said valve sleeve and said inner valve annular gap is formed; a second spring for biasing said valve sleeve into engagement with said closing head and acting constantly in a direction of opening movement of said valve needle; and stop means surrounding said valve needle and secured in said nozzle body for at least partially supporting said second spring.

5. A fuel injection nozzle according to claim 4; further comprising a bushing secured in said nozzle body and having a downstream end surface and an upstream end portion for guiding said valve needle in its displacement in said nozzle body, said upstream end portion having an end shoulder for at least partially supporting said first spring, said stop means having a shoulder abutting said downstream end surface.

6. A fuel injection nozzle according to claim 4, wherein said valve sleeve has a conical front end surface with a cone angle smaller than a cone angle of said conical seat surface of said closing head.

7. A fuel injection nozzle according to claim 4, wherein said valve seat defines a sealing edge having a diameter substantially corresponding to a guide diameter of said valve sleeve in said nozzle body.

8. A fuel injection nozzle according to claim 7, wherein said nozzle body has a spherically curved guiding wall located adjacent said valve seat for directing the fuel umbrella spray said guiding wall having a front end surface, said guiding wall having a cone angle at said front end surface smaller than a cone angle of said conical seat surface of said closing head.

* * * * *